US005941156A

United States Patent [19]

Nagatomo

[11] Patent Number: 5,941,156

[45] Date of Patent: Aug. 24, 1999

[54] FLUID COMMUNICATION VALVE FOR HIGH AND LOW PRESSURE PORTS OF A DIFFERENTIAL HYDRAULIC MOTOR

[75] Inventor: Kuniyasu Nagatomo, Fukuoka, Japan

[73] Assignees: Nagatomo Fluid Machinery Laboratory Ltd., Chikushino; Nissan Motor Co., Ltd., Yokohama, both of Japan

[21] Appl. No.: 08/929,795

[22] Filed: Sep. 15, 1997

[30] Foreign Application Priority Data

Sep. 15, 1996 [JP] Japan ..... 8-279813

[51] Int. Cl.[6] ..... F01B 3/00; F01B 13/04; F04B 27/08

[52] U.S. Cl. ..... 91/482; 91/499; 417/269

[58] Field of Search ..... 92/71, 57; 91/499, 91/482, 485; 74/731; 60/489, 484; 103/5; 417/269

[56] References Cited

U.S. PATENT DOCUMENTS

| | | | |
|---|---|---|---|
| 2,241,046 | 5/1941 | Wahlmark | 92/71 |
| 2,915,974 | 12/1959 | Enemark | 103/5 |
| 3,212,448 | 10/1965 | Johnston | 91/499 |
| 3,799,033 | 3/1974 | Pruvot | 91/499 |
| 3,955,475 | 5/1976 | Horiuchi et al. | 91/492 |
| 4,781,022 | 11/1988 | Hayashi et al. | 60/489 |
| 4,875,390 | 10/1989 | Hayashi et al. | 74/731 |
| 5,058,485 | 10/1991 | Cardillo | 91/499 |
| 5,575,151 | 11/1996 | Hayashi et al. | 60/489 |

FOREIGN PATENT DOCUMENTS

| | | |
|---|---|---|
| 52-5034 | 6/1975 | Japan . |
| 61-153055 | 7/1986 | Japan . |
| 1-250661 | 10/1989 | Japan . |

*Primary Examiner*—Charles G. Freay
*Assistant Examiner*—Robert Z. Evora
*Attorney, Agent, or Firm*—Foley & Lardner

[57] ABSTRACT

A differential hydraulic motor comprises a swash plate joined to an output shaft, and a cylinder block joined to an input shaft. A change-over valve is provided which changes over according to the relative rotation of the output shaft and input shaft, and leads a different fluid pressure to pistons housed in the cylinder block according to whether these pistons are extending or contracting. A rotary distributor is provided which connects a high pressure port and low pressure port in a casing to the change-over valve even when the cylinder block is rotating. This rotary distributor comprises a port block which is free to slide in the casing. Pressure from the high pressure port acts on a piston formed on an end face of the port block so as to push the port block against a sliding surface of a cover block joined to the cylinder block. Annular ports connected to the high pressure port and low pressure port are formed on this sliding surface, and high pressure and low pressure are led to the change-over valve from these annular ports.

7 Claims, 8 Drawing Sheets

FLUID COMMUNICATION VALVE FOR HIGH AND LOW PRESSURE PORTS OF A DIFFERENTIAL HYDRAULIC MOTOR

The contents of Tokuganhei 8-279813, with a filing date of Sep. 15, 1996 in Japan, are hereby incorporated by reference.

FIELD OF THE INVENTION

The present invention relates to a differential hydraulic motor having an output rotation based on an input rotation and a fluid pressure supplied from an external source.

BACKGROUND OF THE INVENTION

Examples of conventions mechanical—hydrostatic transmissions are disclosed for example in Tokai Hei. 1-250661 and Tokkai Sho 6-153055 published by the Japanese Patent Office. These transmissions however do not comprise a rotary distributor for receiving fluid pressure supplied from an external source.

In Tokkai Sho 52-5034, a mechanism is disclosed which is similar to a differential hydraulic motor. The rotation sped nY of the output shaft of this differential hydraulic motor is given by nY=nX+nH where the rotation speed of the input shaft is nX, and nH=(Q/U), where the effective capacity=U and the fluid supply flowrate from a external pump=Q. The rotation speed of a differential hydraulic motor is therefore higher than that of an ordinary hydraulic motor which rotates only due to fluid pressure.

However as this differential hydraulic motor is of such a construction that it rotates together with the cylinder block, a rotary distributor is required for supplying fluid from an external hydraulic pump, and when it is rotating at high speed, problems arise due to frictional losses in the distributor and durability. Further, as the positions in an axial direction of a plurality of pistons disposed inside cylinder block are different, a moment is generated which tilts the cylinder block due to its rotation and the sealtightness of valve plates is easily impaired.

Also, the differential hydraulic motor comprises a spool-shaped change-over valve or a cylinder type change-over valve as described in the aforesaid publications. These change-over valves operate according to the relative rotation of the input shaft and the output shaft. The pistons disposed in the cylinder block extend and contract as they slide on a swash plate. Due to these change-over valves, high pressure is supplied to the pistons as they extend and low pressure when they contract, and the cylinder block therefore rotates continuously.

However, the construction of the fluid flowpath in the spool-shaped change-over valve mentioned in the above publication is complex, and its machinability is not at all satisfactory. In the case of the cylinder type change-over valve on the other hand, sealtightness is easily impaired due to fluid pressure.

SUMMARY OF THE INVENTION

It is therefore an object of this invention to provide a new type of differential hydraulic motor having improved frictional loss characteristics and durability even at high rotation speeds.

It is a further object of this invention to provide a new type of differential hydraulic motor wherein machinability and sealtightness of change-over valves which change over due to the relative rotation of an input shaft and an output shaft, are improved.

In order to achieve the above objectives, this invention provides a differential hydraulic motor which has a swash plate connected in a one-piece construction to an output shaft supported free to rotate via a bearing relative to a casing, a cylinder block supported free to rotate via a bearing coaxial with the output shaft, a plurality of pistons which move back and forth as they slide on the swash plate being disposed on a concentric circle in the cylinder block which is joined to an input shaft in a one-piece construction, and a change-over valve which changes over according to the relative rotation of the output shaft and the input shaft so as to lead a different fluid pressure to a port of cylinders in which the pistons are according to whether the pistons are extending or contracting, a rotary distributor which connects a high pressure port and a low pressure port provided in the casing to the change-over valve even when the cylinder block is rotating.

It is preferable that the rotary distributor comprises a port block situated on the outer circumference of the input shaft such that it is free to slide in the casing, a piston formed on an axial end face of the port block, and an annular port formed on a surface of the port block which slides on a cover block connected to the cylinder block in order to lead high pressure and low pressure to the change-over valve, and high pressure from the high pressure port acts on the piston on the end face of the port block so as to generate a propelling force in an axial direction tending to push port block against the cover block.

It is preferable that the port block comprises two pistons formed on a stepped end face of the port block, and a propelling force is constantly generated in an axial direction even when the positional relationship of the high pressure and low pressure ports is reversed.

It is preferable that the change-over valve is provided in the cylinder block, the change-over valve moves on an eccentric shaft offset relative to the output shaft, and the ports of the cylinders are alternately connected to high pressure and low pressure in sequence by the eccentric rotation of the eccentric shaft relative to the cylinder block.

In this case, it is preferable that the change-over valve comprises a plurality of spool-shaped change-over valves equal in number to the number of the cylinders, the spool-shaped change-over valves are disposed free to slide in a radial direction in the cylinder block, the valves provide a port alternately connected to the high pressure port and the low pressure port, and the valves slide in a radial direction while one end of the valves remains in contact with the eccentric shaft so that the cylinder ports are alternately connected to the high pressure port and the low pressure port in sequence, due to the eccentric rotation of the eccentric shaft.

It is preferable that the change-over valve comprises a ring-shaped change-over valve disposed inside the cylinder block in an annular space concentric with it, an inner chamber and outer chamber inside and outside this ring-shaped change-over valve are partitioned in this annular space, the inner and outer chambers are alternately connected to the high pressure port and the low pressure port, the inner circumferential surface of the change-over valve is pressured by drive rods in contact with the eccentric shaft from a radial direction, and the ports are alternately connected to the inner chamber and the outer chamber in sequence by the eccentric rotation of the ring-shaped change-over valve due to the eccentric rotation of the eccentric shaft.

It is further preferable that the change-over valve comprises a disk-shaped change-over valve disposed inside the cylinder block in an annular spa concentric with it, an annular groove is provided on both sides of the disk-shaped change-over valve so as to form an inner chamber, an outer chamber is formed between the disk-shaped change-over valve and the annular space, the high pressure port and the low pressure port are alternately connected to these inner and outer chambers, the eccentric shaft is embedded in the center of the disk-shaped change-over valve, and the ports are alternately connected to the inner chamber and the outer chamber in sequence by the eccentric rotation of the disk-shaped change-over valve in the annular space due to the eccentric rotation of the eccentric shaft.

It is preferable that the disk-shaped change-over valve comprises seal surfaces formed on an inner side and an outer side of the inner chamber on both lateral faces of the disk-shaped change-over valve.

It is preferable that the disk-shaped change-over valve is split into two parts, a plurality of seal rings are interposed on the split surfaces facing each other, and high pressure is led to the area surrounded by the seal rings.

DESCRIPTION OF THE PREFERRED EMBODIMENTS

Figure 1:
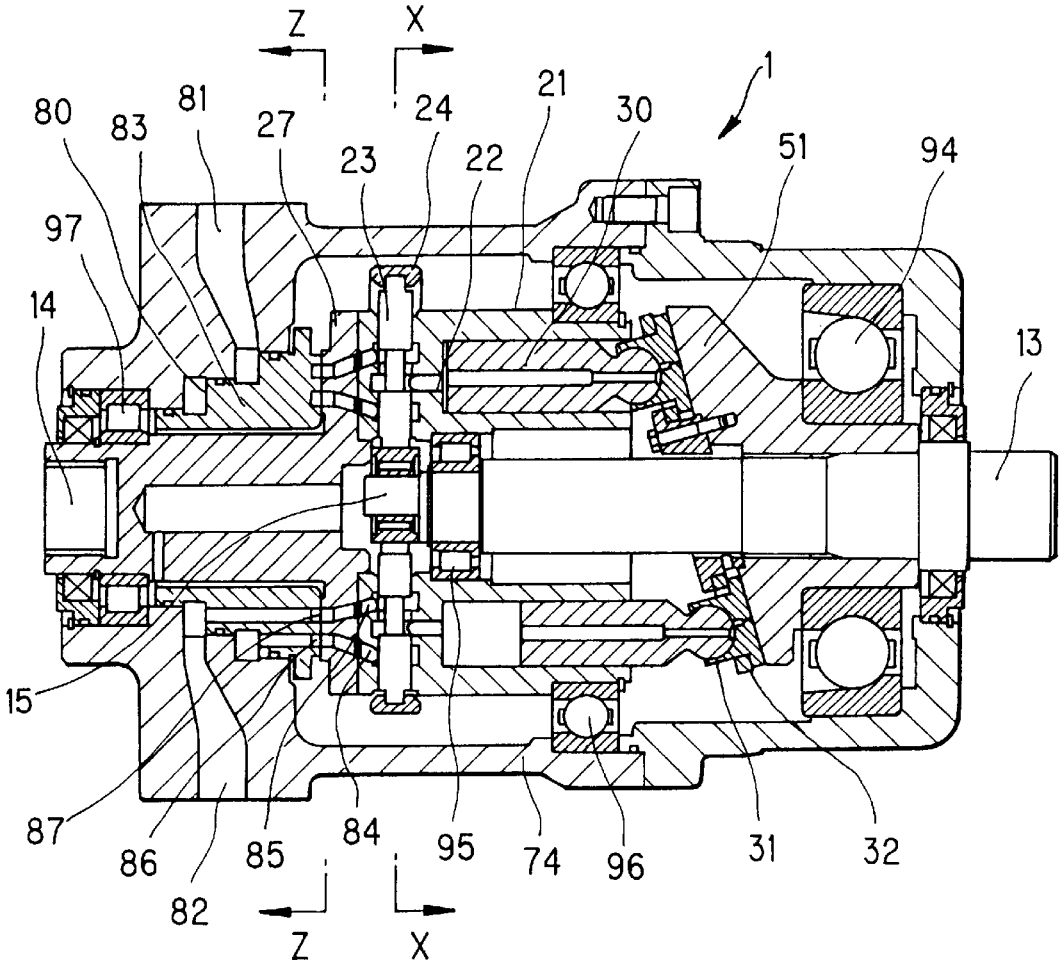
FIG. 1 is a vertical sectional view of a differential hydraulic motor according to a first embodiment of this invention.

Referring to FIG. 1 of the drawings in a casing 74 of a differential hydraulic motor 1, an output shaft 13, which is a first shaft, is supported free to rotate via bearings 94 and 95. A swash plate 51 is connected to this output shaft 13 in a one-piece construction, and rotates together with it. An input shaft 14, which is a second shaft, and a cylinder block 21 connected with this input shaft 14 in a one-piece construction, are supported free to rotate relative to the casing 74 on the same axis as the output shaft 13 via bearings 96, 97.

A plurality of cylinders are disposed in the cylinder block 21 on the same circle at equidistant intervals from one another with the center of the rotation shaft as center, and a piston 30 is inserted free to slide in each of these cylinders. A slipper pad 31, which is connected to a spherical rounded surface of one end of the piston 30, is supported on a sliding surface of the swash plate 51 via a retainer 32. The pistons 30 execute a back-and-forth movement while sliding on the plate 51, and perform one full locomotion cycle when the swash plate 51 performs one rotation relative to the cylinder block 21.

Figure 2:
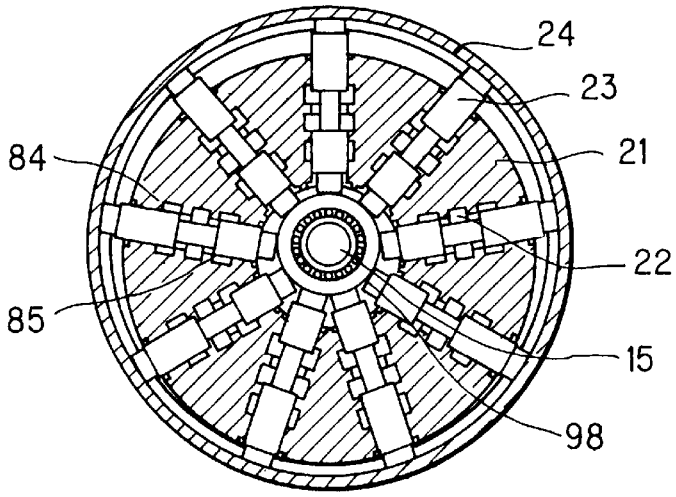
FIG. 2 is a sectional view of a change-over valve along a line X—X in FIG. 1.

An eccentric shaft 15 offset by a predetermined amount from the center of the rotation shaft 13, is provided at one end of the output shaft 13. A plurality of spool-shaped change-over valves 23 are diposed in the cylinder block 21 in a radial alignment from the block center, as shown in FIG. 2. The number of change-over valves 23 is identical to the number of pistons 30, these change-over valves 23 sliding on the outer circumference of a bearing 98 embedded in the eccentric shaft 15. Spool-shaped change-over valves 23 are enclosed by a retaining ring 24 wherein spool-shaped change-over valves 23 slidable contact with the inner circumference of the retaining ring 24 spool-shaped change-over valves 23 are enclosed by a retaining ring 24. When the eccentric shaft 15 rotates relative to the cylinder block 21, the spool-shaped change-over valve 23 is gradually depressed, and a cylinder port 22 provided in the cylinder block 21 is selectly connected to either a high pressure port 84 or a low pressure port 85. When die eccentric shaft 15 performs one rotation, the spool-shaped change-over valve 23 moves forwards and backwards once, high pressure is sent to a port 22 of the group of pistons 30 on the extending side and the port 22 of the group of pistons 30 on the contracting side is connected to low pressure.

The aforesaid high pressure port 84 and low pressure port 85 pass through a cover block 27 connected to the cylinder block 21 in an axial direction. The cover block 27 is formed in a one-piece construction with the input shaft 14, and a rotary distributor 80 slides on an end face of this cover block 27.

Figure 3:
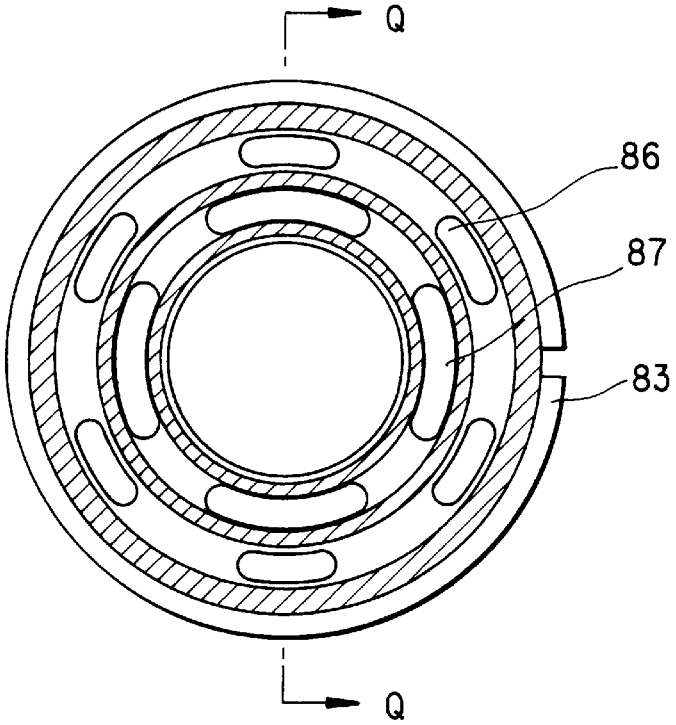
FIG. 3 is a sectional view of a rotary distributor along a line Z—Z in FIG. 1.
Figure 4:
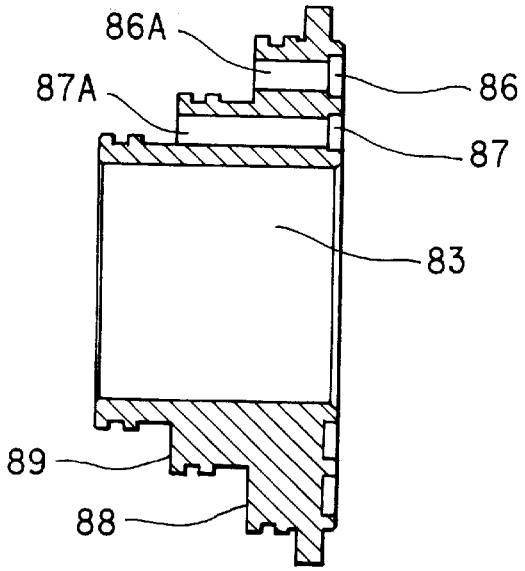
FIG. 4 is a sectional view of rotary distributor along a line Q—Q in FIG. 3.

As shown in FIG. 3 and FIG. 4, a port block 83 comprising the main body of the rotary distributor 80 is formed in the shape of a stepped cylinder, and is inserted relative to the casing 74 such that it can move in an axial direction. A stepped end face of die port block 83 is formed in the shape of pistons 88, 89. When subjected to a fluid pressure it is pressed, and comes in contact with the sliding surface of the cover block 27 at a predetermined pressure. Annular concentric ports 86, 87 are formed on the end face of the port block 83 which slides on the cover block 27, these ports 86, 87 connecting onto the end faces of the pistons 88, 89 via passages 86A, 87A. Ports 81, 82 formed in the casing 74 and to which fluid is supplied from an external source are also connected to the end faces of the pistons 88, 89, and high pressure and low pressure are thereby led to the ports 86, 87. The high pressure port 84 and low pressure port 85 open onto the sliding face of the cover block 27, and the annular ports 86, 87 are constantly connected.

According to this construction, fluid from the ports 81, 82 is continuously led to the spool-shaped change-over valve 23 via the rotary distributor 80 even when the cylinder block 21 rotates.

Figure 5:
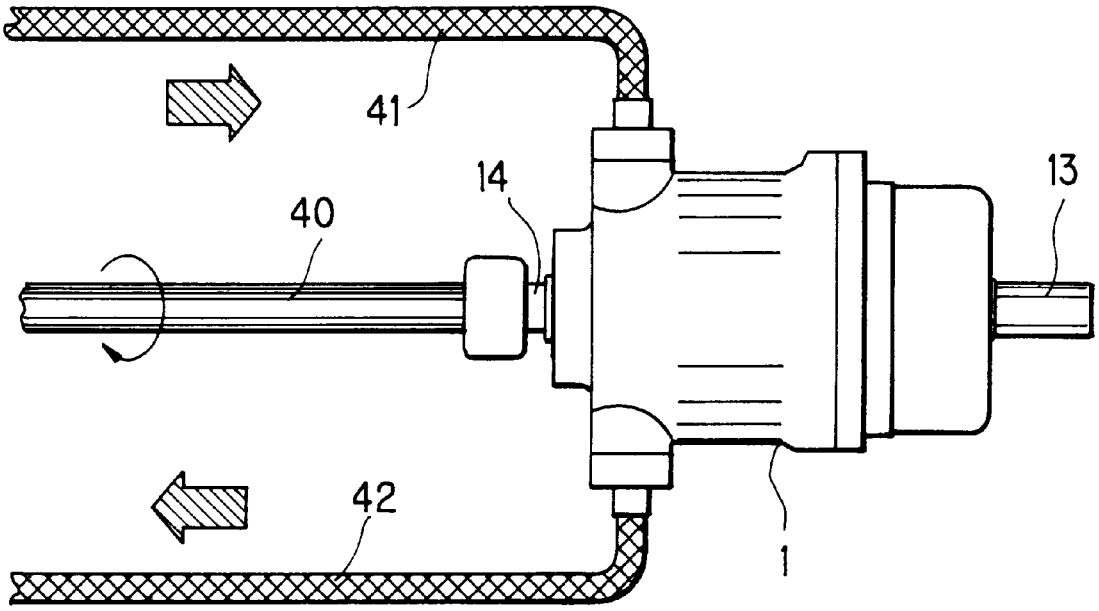
FIG. 5 is a schematic view showing the overall construction.

As shown also in FIG. 5, fluid from a variable capacity hydraulic pump, not shown, is supplied to the differential hydraulic motor 1 by oil pressure pipes 41, 42 connected to the ports 81, 82, and returns to the intake side. At the same time, a rotary drive force is transmitted by a drive shaft 40 connected to the input shaft 14, and the cylinder block 21 rotates together with it.

Next, the action of this embodiment will be described.

When the drive shaft 40 rotates due to an external engine, not shown, the cylinder block 21 rotates together with the input shaft 14. High pressure is led to one of the ports 81, 82 connected to the hydraulic pump via the pipes 41, 42, and low pressure is led to the other of the ports 81, 82. High pressure and low pressure are led to the spool-shaped change-over valve 23 by the rotary distributor 80 even when the cylinder block 21 rotates. Due to the action of this change-over valve 23, high pressure fluid is sent to the port 22 of the group of pistons 30 which is extending, and fluid is discharged from the port 22 of die group of pistons 30 which is contracting.

The pistons 30 press the swash plate 51, the swash plate 51 rotates due to a component force in the rotation direction, and the output shaft 13 rotates together with it. A relative rotation difference arises between the cylinder block 21 and the output shaft 13. As a result, the spool-shaped change-over valve 23 is gradually pressed by the eccentric shaft 15 which rotate together with the output shaft 13, high pressure acts on the pistons 30 which are extending, and the pistons 30 which are contracting are released to low pressure. The swash plate 51 therefore rotates continuously.

The rotation speed nH of the swash plate 51 varies in direct proportion to the fluid flowrate supplied by the hydraulic pump, so the speed increases the more the flowrate increases.

On the other hand, the cylinder block 21 rotates with the same rotation speed nX as the drive shaft 40. The swash plate 51 is subjected to fluid type rotation force, due to the motion of the pistons 30 in the cylinder block 21, which is based on this rotation nX. The rotation speed nY of the output shaft 13 which rotates together with the swash plate 51 is therefore nY=nH+nX.

The rotary force generated by the pistons 30 under fluid pressure varies according to the direction of fluid supplied by the pipes 41, 42 relative to the rotation direction of the drive shaft 40. If the swash plate 51 rotates in the same direction as the drive shaft 40 when the port 81 is at high pressure and the port 82 is at low pressure, the rotary force acting on the swash plate 51 due to the pressing force of the pistons 30 is reversed when the pressures of the ports 81, 82 are reversed, i.e. when the port 81 is at low pressure and the port 82 is at high pressure. In this case, die rotation speed nY the of output shaft 13 is obtained by subtracting nH from nX.

By varying the supply flowrate from the hydraulic pump in this way, the rotation speed of the differential hydraulic motor 1 may be freely increased or decreased, and its rotation speed may be controlled in a stepless manner.

The input shaft 14 and the rotary distributor 80 rotate relative to each other, however since this rotation difference is smaller than the rotation difference relative to the output shaft side, it is advantageous to improve the friction loss and durability of rotating parts.

The pistons 88, 89 are provided on the end face of the port block 83 of the rotary distributor 80. As high pressure is always acting on one of these pistons 88, 89, a propelling force is generated in an axial direction in the port block 83, and the port block 83 is pressed with a suitable pressing force towards its sliding surface with the cover block 27. The sealtightness of the sliding surface is thereby improved and fluid leakage is reduced. Also, due to the fact that the stroke positions of the pistons 30 in the cylinder block 21 are different, a moment is generated in the cylinder block 21 due to its rotation which tends to incline the cylinder block 21. If the cylinder block 21 were to lean, sealtightness with the port block 83 would be lost, however as the sliding surface on the cylinder block side is pressed due to the propelling force acting on the port block 83 as described hereabove, good sealtightness is maintained.

Figure 6:
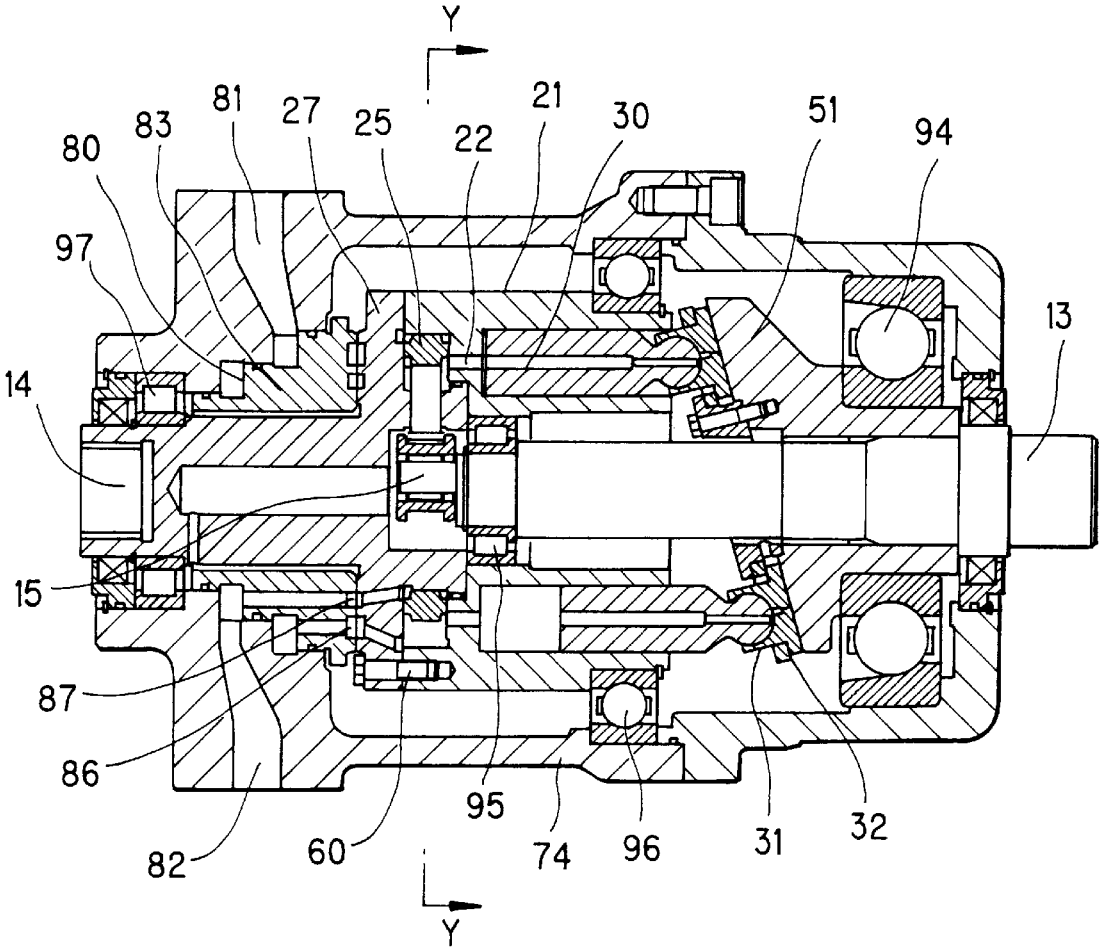
FIG. 6 is a vertical sectional view of a differential hydraulic motor according to a second embodiment of this invention.
Figure 7:
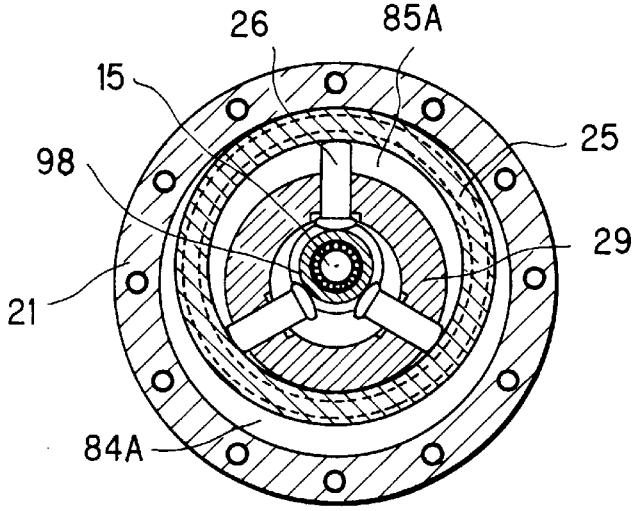
FIG. 7 is a vertical sectional view of a change-over valve along a line Y—Y of FIG. 6.
Figure 8:
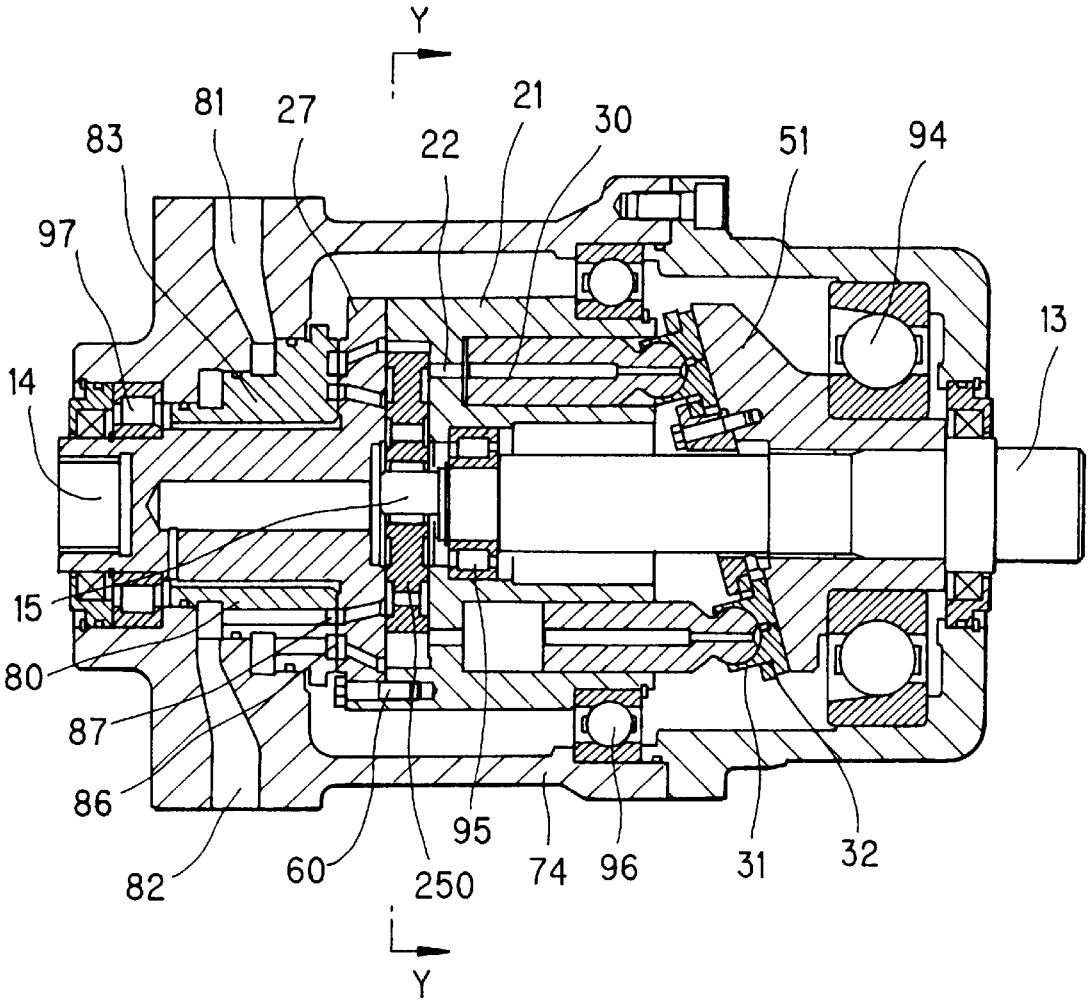
FIG. 8 is a vertical sectional view of a differential hydraulic motor according to a third embodiment of this invention.
Figure 9:
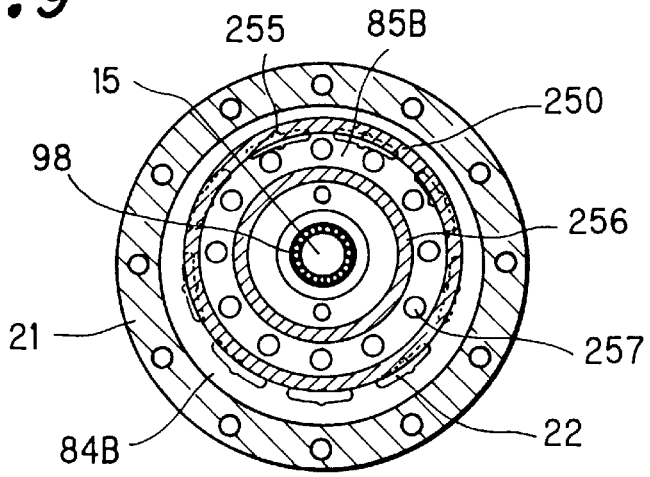
FIG. 9 is a sectional view of a change-over valve along the line Y—Y of FIG. 8.
Figure 10:
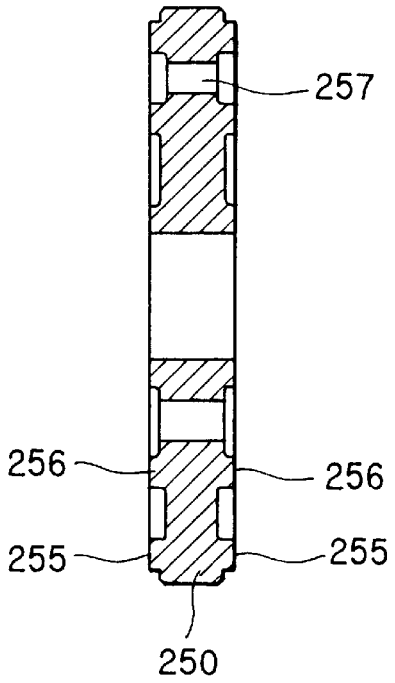
FIG. 10 is another sectional view of a change-over valve.
Figure 11:
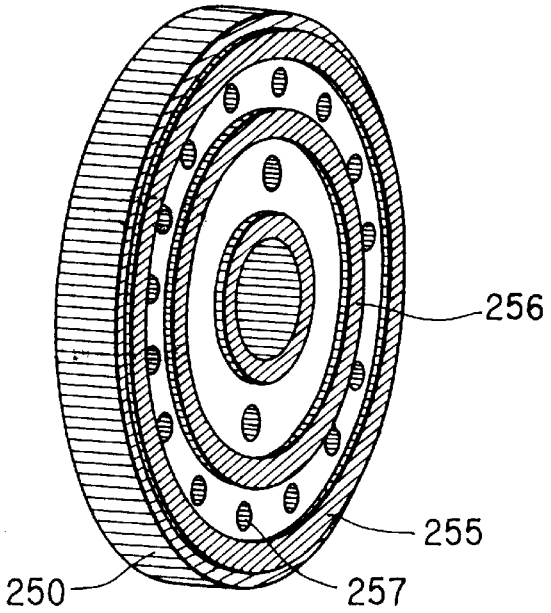
FIG. 11 is a perspective view of a change-over valve.
Figure 12:
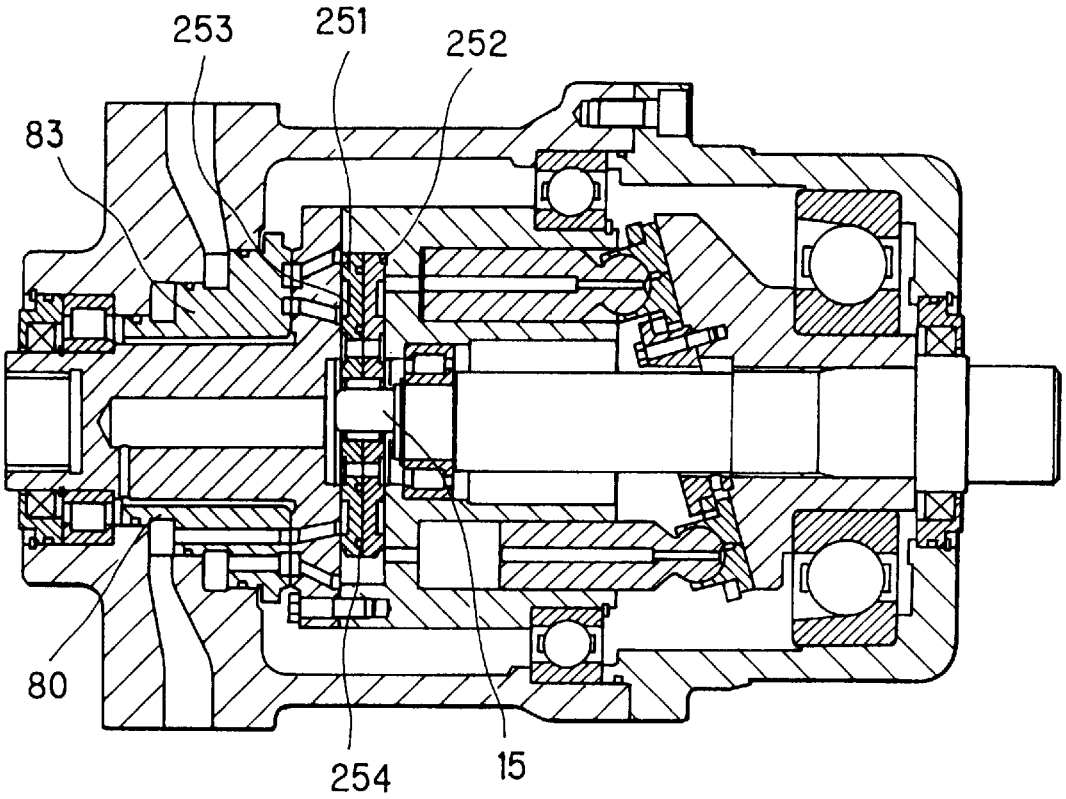
FIG. 12 is a vertical sectional view of a differential hydraulic motor according to a fourth embodiment of this invention.
Figure 13:
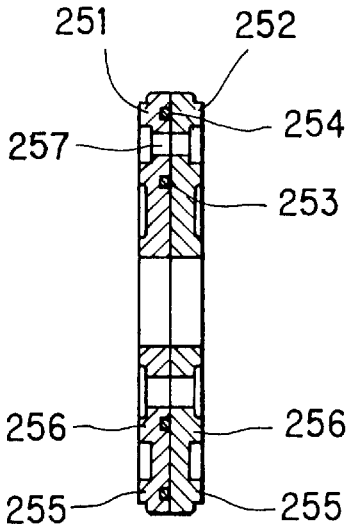
FIG. 13 is a sectional view of a change-over valve.
Figure 14:
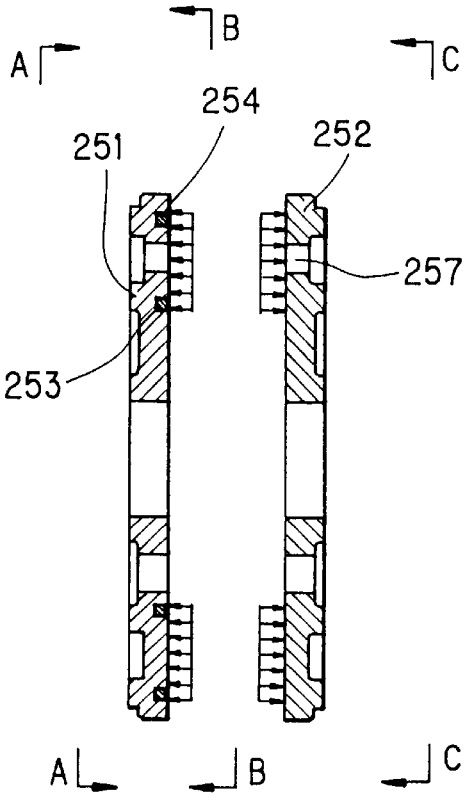
FIG. 14 is a cut-away sectional view of a change-over valve.
Figure 15:
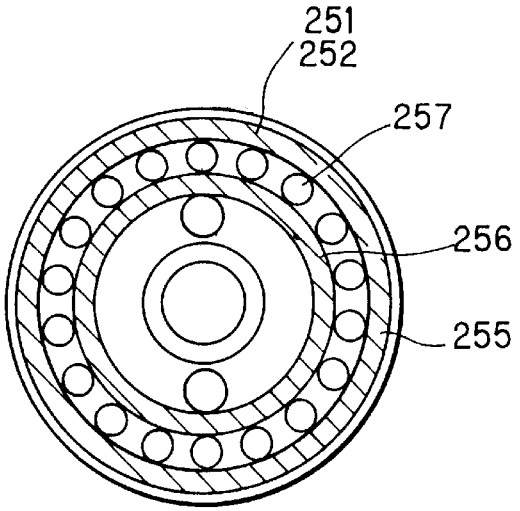
FIG. 15 is a front view of a change-over valve seen from outside.
Figure 16:
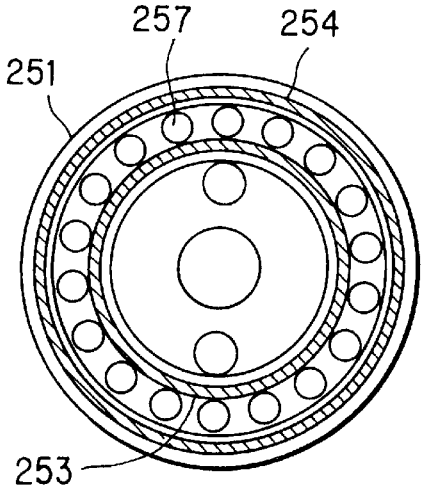
FIG. 16 is a rear view of a change-over valve seen from inside.

Next, a second embodiment of this invention will be described with reference to FIG. 6 and FIG. 7.

According to this embodiment, a ring-shaped change-over valve 25 is provided instead of the spool-shaped change-over valve 23.

A plurality of drive rods 26 come in contact from a radial direction with the outer circumference of a bearing 98 in the aforementioned eccentric shaft 15. These drive rods 26 are free to slide in a radial direction through part of the cover block 27 so as to come in contact with the inner circumferential surface of the ring-shaped change-over valve 25.

The ring-shaped change-over valve 25 which is formed in the shape of a hollow disk is surrounded by the cover block 27 and cylinder block 21, and disposed in an annular space concentrically with these elements. When the drive rods 26 are pressed by the eccentric shaft 15, the change-over valve 25 rotates eccentrically. The change-over valve 25 displaces according to the rotation angle difference between the eccentric shaft 15 and the input shaft 14, and returns to its original position after it has relatively performed one rotation.

In this way, the ports 22 are selectively connected to an outer chamber 84A or an inner chamber 85A of the change-over valve 25. The outer chamber 84A is connected to the aforesaid high pressure port 84 and the inner chamber 85A is connected to the low presume port 85 so as to lead either high pressure or low pressure to the cylinder ports 22.

When fluid is supplied to the port 81 from the hydraulic pump and the port 82 is connected to the return side, the outer chamber 84A of the change-over valve 25 becomes high pressure and the inner camber 85A becomes low pressure. Some of the pistons 30 extend due to high pressure fluid which is sent from the port 22 connected to the side to which high pressure is supplied, and fluid is discharged from the port 22 connected to the lower pressure side so that some of the pistons 30 contract. The output shaft 13 therefore rotates, the eccentric shaft 15 rotates together with it and the change-over valve 25 is pushed by the drive rods 26 so that it rotates eccentrically. The change-over valve 25 changes over so that high pressure is supplied to the group of pistons 30 which is progressively extending, and the group of pistons 30 which is contracting is connected to the low pressure side. As a result, the output shaft 13 rotates continuously.

In this case, a pressure is exerted on the cover block 27 by the outer chamber 84A wherein supplied high pressure tending to separate it in the axial direction from the cylinder block 21, however the cover block 27 is pushed back by a pressing force in the axial direction acting on the port block 83 of the rotary distributor 80. Pressure balance is maintained by arranging the pressure-receiving surface area on the high pressure side of the cover block 27 to correspond with the pressure-receiving surface area of the piston 88 of the port block 83.

Next, a third embodiment will be described with reference to FIG. 8–FIG. 11.

According to this embodiment, a disk-shaped change-over valve 250 is provided. In the disk-shaft change-over valve 250, the aforesaid eccentric shaft 15 is inserted via the bearing 98 into a circular disk plate. The disk-shaped change-over valve 250 is diposed in the annular space formed between the cylinder block 21 and the cover plate 27, as in the case of the aforementioned ring-shaped change-over valve 25.

An outer chamber 84B is formed outside the disk-shaped change-over valve 250, and annular grooves are provided on both sides of the disk to form inner chambers 85B. Seal surfaces 255, 256 are formed on the inside and outside of the inner chambers 85B. The inner chambers 85B on both sides of the disk are connected by throughholes 257.

The outer chamber 84B is always connected to the high pressure port 84, and the inner chambers 85B are always connected to the low pressure port 85.

Due to this construction, when the disk-shaped change-over valve 250 performs eccentric rotation together with the eccentric shaft 15, the cylinder ports 22 are connected in turn to the outer chamber 84B and inner chambers 85B, the pistons 30 extend one after another, and the swash plate 51 rotates continuously.

As the inner chambers 85B on both sides of the disk are enclosed by the seal surface 255, 256, there is little fluid leakage from the sliding surface. Also, due to the pressure acting on the high pressure outer chamber 84B, there is a force tending to separate the cover block 27 from the cylinder block 21, however in the same way as described hereabove, this is canceled out by the pressing force of the portblock 83.

Next, a fourth embodiment of this invention will be described with reference to FIG. 12–FIG. 16.

According to this embodiment, the disk-shaped change-over valve is split into two disk-shaped change-over valves 251, 252. Seal rings 253, 254 are embedded in one of the inner surfaces of the two disk-shaped change-over valves 251, 252 so as to seal the area around a throughhole 257.

The remainder of the construction is the same as that described heretofore. In this case therefore, when two outer surfaces of the disk-shaped change-over valves 251, 252 wear down, the fluid pressure acting on the inner surfaces separates the valves to compensate for the outer surface wear. The seal rings 253, 254 regain their shape elastically so that leakage of fluid from the inner surfaces is prevented.

The area around the seal rings 253, 254 must be kept at high pressure, hence the low pressure and high pressure supplied to the ports 84, 85 must be reversed. In other words, it is necessary to lead high pressure to the throughhole 257.

What is claimed:

1. A differential hydraulic motor, comprising:

a swash plate connected to an output shaft supported free to rotate within a casing via a first bearing;

an input shaft, disposed coaxially with said output shaft;

a cylinder block, connected to said input shaft, supported free to rotate via a second bearing within said casing;

a plurality of pistons, which move back and forth in a plurality of cylinders as said pistons slide on said swash plate, being disposed on a concentric circle in said cylinder block; and a rotary distributor that connects a high pressure port and a low pressure port provided in said casing to a change-over valve during rotation of said cylinder block, wherein said rotary distributor further comprises a port block which is situated on the outer circumference of said input shaft and supported free to slide in said casing, first and second piston portions formed on a stepped end face of said port block, and two annular ports on a surface of said port block which slides on a cover block connected to said cylinder block to lead high pressure and low pressure to said change-over valve, wherein high pressure from said high pressure port acts on said first piston portion on said end face of said port block to generate a propelling force in an axial direction to push said port block against said cover block when a positional relationship of said high pressure port and low pressure port is reversed.

2. A differential hydraulic motor as defined in claim 1, further comprising:

an eccentric shaft offset by a predetermined amount from a central axis of said output shaft, wherein said change-over valve is movably coupled to said eccentric shaft such that when said eccentric shaft rotates relative to said cylinder block said change-over valve is gradually depressed and cylinder ports of said cylinders are alternately connected to high pressure and low pressure in sequence.

3. A differential hydraulic motor as defined in claim 2, wherein said change-over valve comprises:

a plurality of spool-shaped change-over valve spools equal in number to the number of said cylinders, said spool-shaped change-over valve spools disposed free to slide in a radial direction in said cylinder block, wherein said spool-shaped change-over valve spools provide a port alternately connected to said high pressure port and said low pressure port, and said spool-shaped change-over valve spools slide in a radial direction while one end of said spool-shaped change-over valve spools remains in contact with said eccentric shaft so that said cylinder ports are alternately connected to said high pressure port and said low pressure port in sequence, due to eccentric rotation of said eccentric shaft.

4. A differential hydraulic motor as defined in claim 2, wherein said change-over valve comprises:

a ring-shaped change-over valve disposed inside said cylinder block in an annular space concentric with said cylinder block; and an inner chamber and an outer chamber respectively inside and outside said ring-shaped change-over valve partitioned in said annular space, said inner and outer chambers alternately connected to said high pressure port and said low pressure port, wherein an inner circumferential surface of said ring-shaped change-over valve is pressed by drive rods in contact with said eccentric shaft from a radial direction, and wherein said high and low pressure ports are alternately connected to said inner chamber and said outer chamber in sequence by eccentric rotation of said ring-shaped change-over valve due to eccentric rotation of said eccentric shaft.

5. A differential hydraulic motor as defined in claim 2, wherein said change-over valve comprises:

a disk-shaped change-over valve disposed inside the cylinder block in an annular space concentric with said cylinder block, wherein an annular groove is provided on both sides of said disk-shaped change-over valve to form an inner chamber, wherein an outer chamber is formed between said disk-shaped change-over valve and said annular space, said high pressure port and said low pressure port are alternately connected to the inner and outer chambers, said eccentric shaft is embedded in the center of said disk-shaped change-over valve, and wherein said ports are alternately connected to said inner chamber and said outer chamber in sequence by eccentric rotation of said disk-shaped change-over valve in said annular space due to eccentric rotation of said eccentric shaft.

6. A differential hydraulic motor as defined in claim 5, wherein said disk-shaped change-over valve has seal surfaces formed on an inner side and an outer side of said inner chamber on both lateral faces of said disk-shaped change-over valve.

7. A differential hydraulic motor as defined in claim 5, wherein said disk shaped change-over valve is divided into first and second parts, wherein a plurality of seal rings are interposed on the split surfaces of said first and second parts facing each other, and wherein high pressure is led through a passage formed in an area of said first and second parts surrounded by said seal rings.

* * * * *